United States Patent [19]

Ohuchi et al.

[11] 4,077,810

[45] Mar. 7, 1978

[54] ALUMINUM ALLOYS HAVING IMPROVED MECHANICAL PROPERTIES AND WORKABILITY AND METHOD OF MAKING SAME

[75] Inventors: Yasushi Ohuchi, Katsuta; Takeo Tamamura, Hitachi; Naotatsu Asahi, Hitachi; Makoto Nakayama, Hitachi; Hisanobu Kanamaru, Katsuta; Arinobu Hamada, Yokohama; Yasuhiro Takahashi, Yokohama; Kozo Tabata, Mitaka; Ryota Mitamura, Yokohama, all of Japan

[73] Assignees: Hitachi, Ltd.; Showa Denko K.K., both of Japan

[21] Appl. No.: 567,009

[22] Filed: Apr. 10, 1975

[30] Foreign Application Priority Data

Apr. 20, 1974 Japan ..... 49-44851

[51] Int. Cl.[2] ..... C22F 1/04

[52] U.S. Cl. ..... 148/2; 29/527.7; 75/142; 148/3; 148/11.5 A; 148/12.7 A; 148/32; 148/32.5

[58] Field of Search ..... 148/2, 3, 11.5 A, 12.7 A, 148/159, 32, 32.5; 75/142, 143; 29/527.7

[56] References Cited

U.S. PATENT DOCUMENTS 1,508,556 9/1924 Jeffries et al. ..... 148/3

*Primary Examiner*—R. Dean

*Attorney, Agent, or Firm*—Craig & Antonelli

[57] ABSTRACT

An aluminum alloy consisting essentially of 8 to 15% by weight of silicon, 0.05 to 0.7% by weight of magnesium, 1 to 4.5% by weight of copper, the balance being aluminum, wherein a silicon crystal in eutectic structure crystallized out in an aluminum matrix has a mean grain size not larger than 5 microns and intermetallic compounds of magnesium and copper are finely precipitated in the matrix as age-hardening elements for the matrix, and the alloy has at least 40 kg/mm$^2$ tensile strength and at least 10% elongation, good antiwearing and excellent workability.

The disclosure is also concerned with a method of making the above-mentioned aluminum alloy.

23 Claims, 23 Drawing Figures

90°c/sec

25°c/sec

15°c/sec

5°c/sec

15°c/sec

5°c/sec

ALUMINUM ALLOYS HAVING IMPROVED MECHANICAL PROPERTIES AND WORKABILITY AND METHOD OF MAKING SAME

The present invention relates to aluminum alloys particularly suitable for construction or structural materials, which have excellent mechanical properties including tensile strength, elongation and workability, and more particularly to aluminum alloys having a tensile strength not less than 40 kg/mm$^2$, an elongation not less than 10%, not greater than $8 \times 10^{-9}$ mm$^2$/kg of specific wearing-out amount and excellent workability. The present invention also relates to a method of making the above-mentioned improved aluminum alloys.

There have been known quite different kinds of aluminum alloys. Recently, there have been made attempts to use aluminum alloys as a substitute for ferrous or steel structural materials. When the aluminum alloys are used for this purpose, it is required that the alloys have at least 40 kg/mm$^2$ of tensile strength, at least 10% of elongation, not greater than $8 \times 10^{-9}$ mm$^2$/kg of specific wearing-out amount and excellent workability. These properties are hereinafter referred to as "necessary mechanical properties", because these are the minimum requirements for the aluminum alloys when used as a structural material.

The conventional aluminum alloys are, however, unsatisfactory in all or some of the necessary mechanical properties. For example, most of them have only 30 kg/mm$^2$ or less of tensile strength and several % of elongation. Among the conventional aluminum alloys a corrosion resistant aluminum alloy which contains magnesium has good workability, but is quite poor in tensile strength. So-called high strength aluminum alloys which contain copper and magnesium as age-hardening elements have high mechanical strength, but are very poor in workability and have very low wearing-out property.

Accordingly, it is an object of the present invention to provide aluminum alloys possessing at least 40 kg/mm$^2$ of tensile strength, at least 10% of elongation, not greater than $8 \times 10^{-9}$ mm$^2$/kg of specific wearing-out amount and excellent workability.

The present invention is based upon a discovery that when an aluminum alloy of a certain chemical composition is cast under conditions such that that silicon crystals in the eutectic structure are finely and homogeneously crystallized out in an aluminum matrix and the resulting casting is subjected to plastic working and age-hardening, the thus produced aluminum alloy has excellent mechanical properties which have never been found in the conventional aluminum alloys.

Features and advantages of the present invention will be apparent from the following detailed description taken in conjunction with the attached drawings in which:

FIGS. 1*a* – 1*d* are rough sketches of representative forms of silicon crystals in eutectic structure;

Figure 6A:
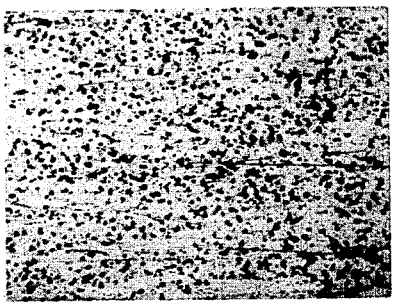
Figure 6B:
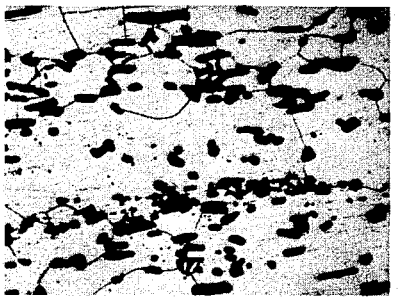
Figure 7:
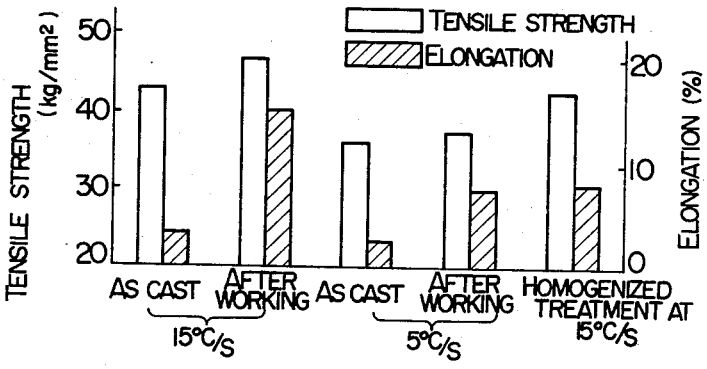
Figure 8:
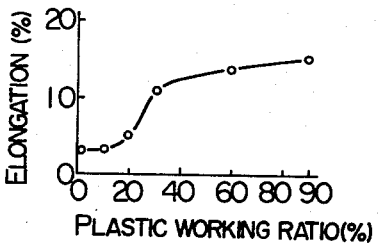
Figure 9:
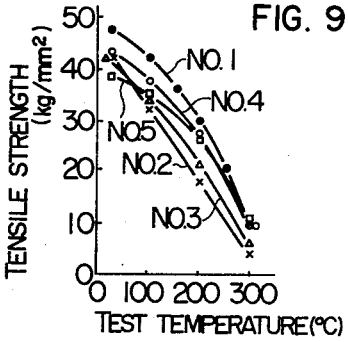
Figure 10:
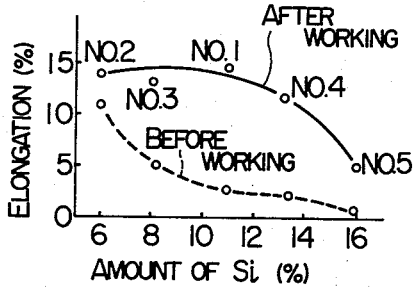
Figure 11:
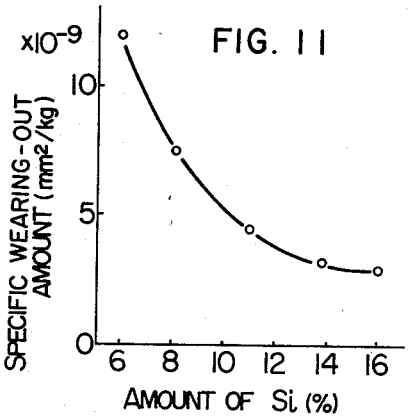
Figure 12:
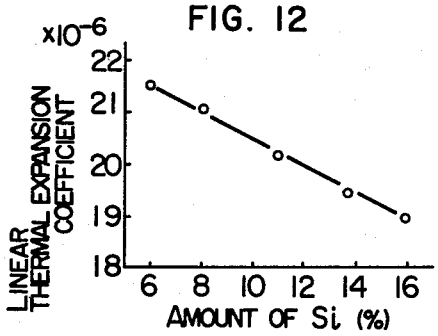
Figure 13:
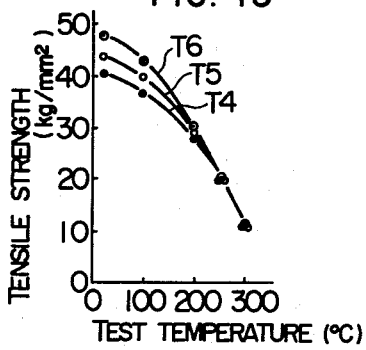
Figure 14:
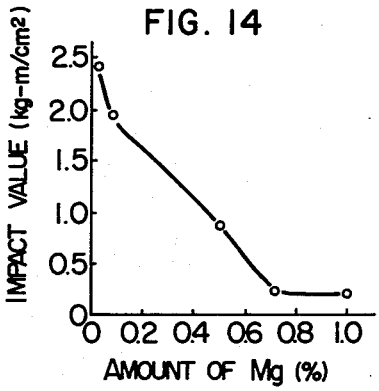
Figure 15:
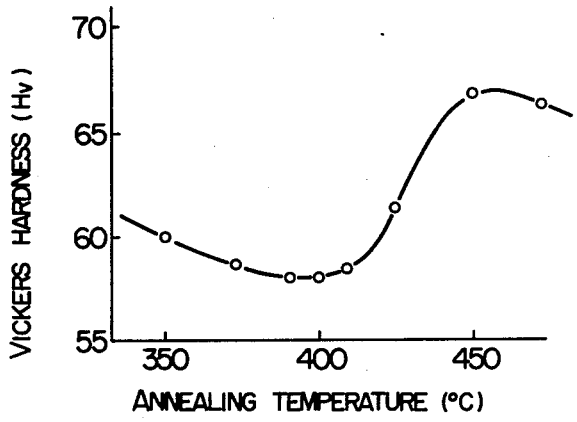
Figure 16:
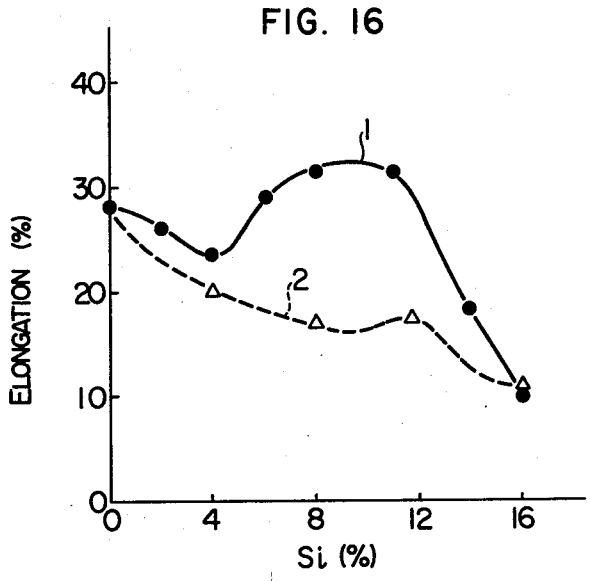

FIGS. 5*a* – 5*d* are microscopic photographs which show the structures of an ingot at various cooling rate;

FIGS. 6*a* – 6*b* are microscopic photographs of alloy after aging treatment;

FIG. 7 is a graph which shows change in mechanical properties depending on cooling rate and plastic working;

FIG. 8 is a graph which shows relation between plastic working ratio and elongation;

FIG. 9 is a graph which shows relation between tensile strength and temperature depending on difference in compositions of alloy;

FIG. 10 is a graph which shows relation between content of silicon and elongation;

FIG. 11 is a graph which shows relation between content of silicon and specific wearing-out amount;

FIG. 12 is a graph which shows relation between content of silicon and linear thermal expansion coefficient;

FIG. 13 is a graph which shows relation between various heat treatments and tensile strength;

FIG. 14 is a graph which shows relation between content of magnesium and impact value;

FIG. 15 is a graph which shows relation between annealing temperature and Vicker's hardness;

FIG. 16 is a graph which shows relation between content of silicon and elongation, after annealing.

Figure 1A:
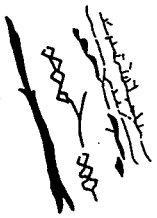

The alloy components per se of the present invention are similar to the known aluminum alloys for casting or wrought. However, the inventors have found as the result of intensive research that the desired new aluminum silicon alloy's composition must be chosen from other view point than that of ordinary casting and wrought (also, casting condition, heat treatment, method of plastic working etc.). Aluminum alloys having some decided composition have sufficient plastic working effect and heat treatability and their metallographical structure is important. That is, it is necessary in order for the ingot to have plastic workability that silicon crystal in eutectic structure and primary silicon crystal in the ingot have a specific shape and size. According to the inventors' research, the silicon crystal in eutectic structure is crystallized in long tabular or flaky form in an ingot as shown in FIG. 1*a* and the narrower the width of said tabular or flaky silicon crystal in eutectic structure is, the better the plastic working effect is. Specifically, when the mean width of silicon crystal in eutectic structure is smaller than 5 μm, good plastic workability is brought about. The term "mean width" is used herein because since it is necessary for subjecting an ingot to sufficient plastic working that the ingot has plastic workability substantially all over it, the maximum width of silicon crystal in eutectic structure must be at 5 μm or less not only in a part of the ingot, but also in the entire cross section. Therefore, refining of only the surface of an ingot with a permanent mold as usual does not result in sufficient plastic workability.

Figure 1B:
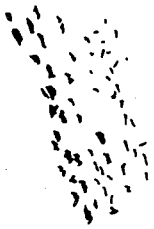
Figure 1C:
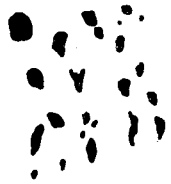
Figure 1D:
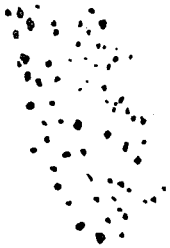

As a result of plastic working, silicon crystal in eutectic structure is divided in its longitudinal direction as shown in FIG. 1*b* and subsequent heat treatment results in somewhat roundish crystal grains as shown in FIG. 1*d*, which are called granular crystals, namely, those having a ratio of longer diameter to shorter diameter of less than about 2. In any case, the obtained aluminum-silicon alloy has good mechanical properties and workability (such as machinability, forgibility, etc.) and large elongation (more than 10%).

On the other hand, although primary silicon crystal has an effect on the plastic workability of an ingot, it has greater effect on machinability, and the mechanical properties of an aluminum-silicon alloy. Since this primary silicon crystal does not nearly change its size and shape by plastic working and heat treatment, the casting process must have a certain condition. In a hypo-eutectic system the primary silicon crystal is not crystallized in so much amount while it is crystallized in mass form in hyper-eutectic system containing silicon in an amount exceeding the eutectic point. When said primary silicon crystal content is 6% or less of area ratio of the matrix and has a maximum grain size of not more than 50 $\mu$, no adverse effect is given occurs on plastic workability of the ingot or on machinability, and the mechanical properties of the aluminum-silicon alloy. The area ratio of primary silicon in the matrix is determined by microscopic sight field of a cross-section of the alloy.

Crystallization of primary silicon crystal and silicon crystal in eutectic structure as mentioned above depends greatly upon the method of production of an ingot and the subsequent treatments. In the conventional castings where silicon crystal in eutectic structure is crystallized in aluminum-silicon alloy, silicon is added mainly for improvement of fluidity of melt and the casting structure clearly comprises eutectic silicon crystal and hyper-eutectic alloy coarse primary silicon crystal also. Such coarse silicon crystal once crystallized can hardly be made fine even by plastic working or heat treatment. In short, in the conventional castings, satisfactory mechanical properties and machinability cannot be imparted due to the coarse primary silicon crystal and eutectic silicon crystal. On the other hand, a continuous casting method is usually employed for production of aluminum-silicon alloy used as a wrought alloy and the casting is conducted by merely diverting the continuous casting method employed for production of aluminum alloy containing silicon in an amount of mere impurity. Therefore, primary silicon crystal and silicon crystal in eutectic structure are also coarse. Especially, in the case of high-strength aluminum alloy containing precipitated strengthening components such as copper, magnesium, etc., it is necessary to conduct a homogenizing treatment or similar heat treatments after casting to remove segregation which occurs at the solidification of the melt. The silicon crystal in eutectic structure is also made coarse by these heat treatments.

According to the inventors' intensive researches, it has been found that in the case of aluminum-silicon alloy having the compositions as mentioned before, when casting is conducted in such a manner that maximum solid cooling rate after completion of solidification of melt is not less than 10° C/sec, silicon crystal in eutectic structure and primary silicon crystal are dispersed finely and homogeneously in matrix. Since mean width of silicon crystal in eutectic is especially not more than 5 $\mu$m, the specific effect that the eutectic silicon is easily divided in its longitudinal direction by plastic working is brought about.

When size of maximum grains of primary silicon crystal is more than 50 $\mu$m, stress is concentrated to this portion to cause extreme reduction in mechanical properties of the aluminum matrix. However, when an ingot is produced under the condition that the solid cooling rate is not less than 10° C/sec as mentioned above, primary silicon crystal does not become greater than 50 $\mu$m and is at most 5 $\mu$m in average.

Figure 2:
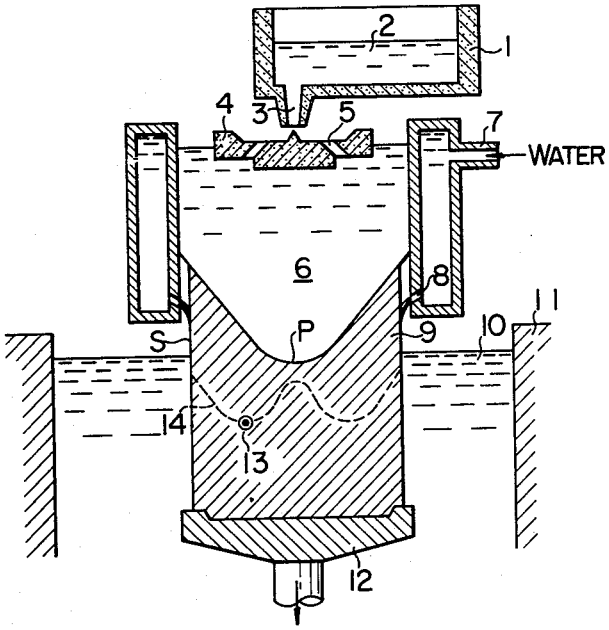
FIG. 2 is a drawing which shows one embodiment of production of an ingot by continuous casting process.
Figure 3:
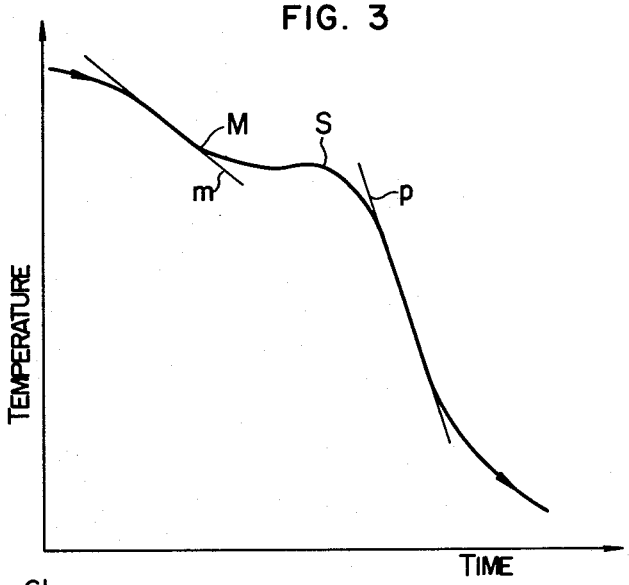
FIG. 3 is a typical cooling rate of continuous casting for aluminum silicon alloy.

The term "solid cooling rate" herein used has the following meaning. That is, the size of silicon crystal in eutectic structure and primary silicon crystal varies depending on cooling rate of ingot. Determination of the cooling rate can be made in various ways. According the the inventors' examination, in order that size of silicon crystal may be exactly within the desired range, cooling rate of the portion of an ingot where the cooling rate is the lowest should be adopted as a standard cooling rate. For example, in the case of continuous casting, as shown in FIG. 2, the solid cooling rate is the maximum cooling rate after solidification at the portion 13 where the cooling rate after solidification is the lowest between the top position P of metal pool in the ingot and outer circumference S. In both continuous casting and casting by water cooling metal mold, the portion where the cooling rate is the lowest can be previously known by conducting experimentally the casting together with, e.g., a thermo-couple placed at a predetermined position. Typical change in temperature at solidification is shown in FIG. 3, wherein melt is cooled at a maximum cooling rate of m° C/sec, solidification begins at point M and terminates at point S and the maximum cooling rate after completion of the solidification in s° C/sec.

Presence of bubbles, segregation and impurities in ingot makes working and heat treatment of the ingot difficult. Therefore, when the ingot is solidified in a certain direction, no defects are confined in the ingot and so homogeneous structure can be obtained. In this sense, the methods according to which melt pool is formed in the upper part such as continuous casting and casting by water cooling metal mold are useful. Thus obtained ingot having little internal defects and having a high homogeneity is first subjected to plastic working of more than 30% and then heat treatment such as quench-aging treatment to obtain aluminum-silicon alloy which is unexpectedly excellent in all characteristics.

Thus produced aluminum-silicon alloy of the present invention has an elongation of at least 10% and a tensile strength of at least 40 kg/mm$^2$ and mechanical properties nearly equal to those of duralumin of JIS 2017. However, the aluminum-silicon alloy of the present invention has no sensitivity to cracks due to stress corrosion which is the greatest defect of duralumin and is much superior to duralumin in abrasion resistance. It is further important that aging-treatment of duralumin requires 15 hours at 170° C while the aluminum alloy of the present invention requires only about 5 hours and thus it has great effect of saving heat energy. Such high strength and easiness in aging are largely due to its alloy components and also due to the fineness of silicon crystal in eutectic structure and primary silicon crystal.

Due to high homogeneity in structure, high silicon content and strengthening effect of magnesium and copper, the aluminum-silicon alloy of the present invention possesses simultaneously tenacity, stress corrosion cracking resistance, corrosion resistance, sand sintering resistance, impact resistance, creep resistance, abrasion resistance, low linear thermal expansion coefficient, high damping capacity, free cutting property, good plastic workability, easy precipitation hardenability, weldability, mass-producibility, etc.

Reasons for restriction of the contents of the alloy components of the present invention are as follows:

The content of silicon is 8 – 15% by weight, preferably 9 – 14% by weight, most preferably the range near the eutectic point (about 11 ± 1% by weight). When silicon content is less than 8% by weight, proportion of eutectic structure in the alloy becomes less than 68% in area ratio and the desired abrasion resistance and hardness cannot be obtained. When the silicon content is 9%, proportion of eutectic structure exceeds 75% in area ratio and hence the desired properties can stably be obtained regardless of some changes in components. In the case of the equilibrium bi-component system of aluminum-silicon, eutectic point is present at the silicon content of 11.7% by weight. However, when a third element is added or cooling state is changed, the eutectic point actually transfers. In the hyper-eutectic area which contains silicon in an amount greater than that of the eutectic point, the primary silicon crystal is firstly crystallized at solidification. However, when the solidification of the alloy containing less than 14% by weight of silicon can be started in non-equilibrium by rapid cooling, it is possible to control the size of the primary silicon crystal and to increase tenacity. When silicon content is more than 15% by weight, amount of primary silicon crystal and that of distribution are great to cause reduction in machinability and elongation.

Magnesium forms precipitates such as $Mg_2Si$ and exhibits a remarkable effect on strengthening by heat treatment. The content of magnesium having relation with the content of copper is suitably 0.05 - 0.7% by weight and especially 0.2 - 0.4% by weight. When the magnesium content is less than 0.05% by weight, the amount of intermetallic compound such as $Mg_2Si$ formed is small, precipitation strengthening of the matrix is insufficient and machinability is lowered. On the other hand, with increase in the magnesium content, tensile strength and hardness are increased, but impact value is decreased and when it exceeds 0.7% by weight, impact resistance cannot be secured. When the magnesium content is further increased, fluidity of melt at casting becomes low and scabs are caused. Formation of severe scabs of the ingot in mass-production is significant problem from the viewpoint of operability and yield rate.

Figure 4:
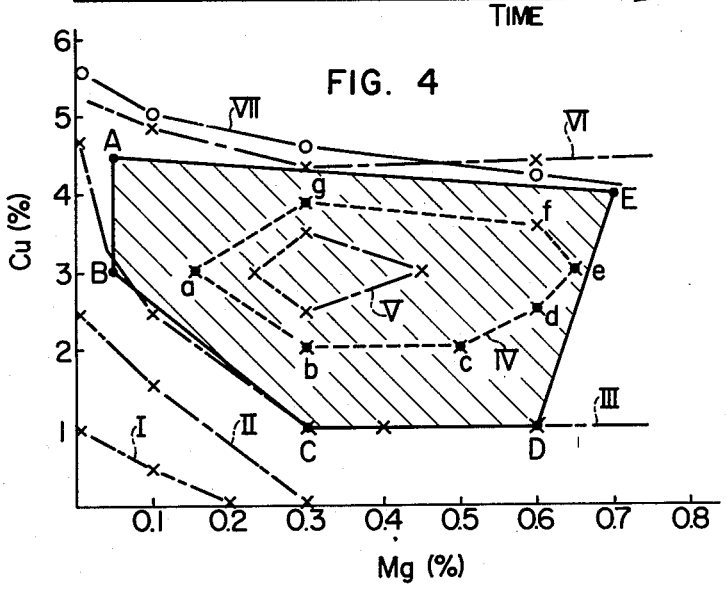
FIG. 4 is a graph which shows mechanical properties of an alloy depending on contents of magnesium and copper.
Figure 5A:
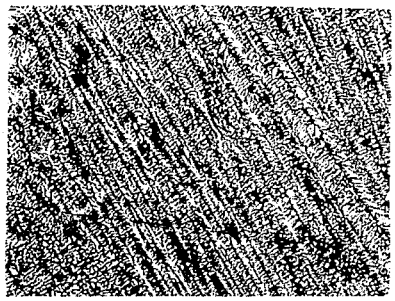
Figure 5B:
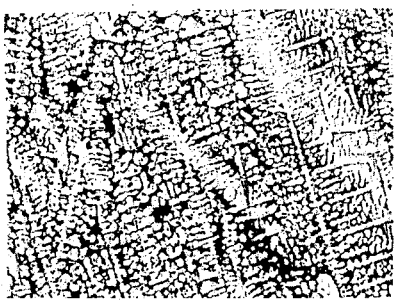
Figure 5C:
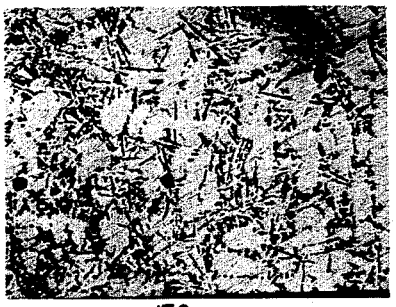
Figure 5D:
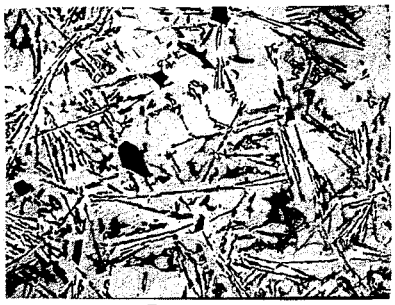

Copper is useful for improvement in mechanical properties and abrasion resistance. It exhibits the effect with addition of at least 0.5% by weight and provides the highest strength at vicinity of 3% by weight in addition when it contains 0.3% by weight of magnesium. When the copper content exceeds 4.5% by weight, cracks tend to occur at production of the ingot, sensitivity to stress corrosion cracking is increased and strength and elongation are also gradually decreased. Therefore, upper limit of the copper content is 4.5% by weight. In the alloy of the present invention, proportion of said Mg and Cu contents and working rate are important and, as shown in FIG. 4, the mechanical properties depend on the proportion of the said two elements added. That is, FIG. 4 shows tensile strength curves of the alloy when the alloy having fine and homogeneous structure as mentioned above was subjected to plastic working of 80% and then to $T_6$ treatment. In FIG. 4, I is iso-strength curve of 20 kg/mm², II is that of 30 kg/mm², III and VII are those of 40 kg/mm², IV is that of 45 kg/mm² and V is that of 48 kg/mm². The area below the chain line VI in FIG. 4 is the area where elongation is at least 10%. The alloys having the structure within the area surrounded by the line connecting points A, B, C, D, E and A have a strength of at least 40 kg/mm² and simultaneously satisfy the other various properties. That is, the composition within the area surrounded by the line connecting point A (Cu 4.5%, Mg 0.05%), B (Cu 3%, Mg 0.05%), C (Cu 1%, Mg 0.3%), D (Cu 1%, Mg 0.6%), E (Cu 4%, Mg 0.7%) and the point A is preferred. The lighest tenacity of at least 10% in terms of elongation and at least 45 kg/mm² in strength is obtained within the area surrounded by the line connecting point a (Cu 3%, Mg 0.15%), b (Cu 2%, Mg 0.3%), c (Cu 2%, Mg 0.5%), d (Cu 2.5%, Mg 0.6%), e (Cu 3.0%, Mg 0.65%), f (Cu 3.5%, Mg 0.6%), g (Cu 3.9%, Mg 0.3%) and the point *a*.

Iron is an inevitable impurity and also has an effect of strengthening the matrix, but tends to produce needle-like crystal such as $Al_4FeSi$ to damage the tenacity of the alloy. Therefore, iron content is restricted to not more than 0.7% by weight and especially less than 0.4% by weight.

Besides the components mentioned above, the alloy of the present invention can contain other components, if necessary. It has been confirmed that, for example, addition of chromium, manganese, nickel, zirconium or titanium in a small amount can increase mechanical strength in the area of high temperature without increasing the sensitivity to stress corrosion cracking. However, addition of these metals causes a damage in tenacity and so the amount thereof is desirably kept at less than about 0.15% by weight. Addition of inoculants such as strontium, sodium, phosphorus, etc. to melt can prevent growth of silicon crystal in eutectic structure or primary silicon crystal to provide the effect of refining of crystal in ingot alloy and improvement of mechanical properties. Especially when hyper-eutectic alloy containing 13 - 15% of silicon is cast at a solid cooling rate of about 10° C/sec, it is preferred to add suitable inoculants.

In the present invention, to solid cooling rate is specified as at least 10° C/sec and according to such cooling rate the mean width of flaky silicon crystal in eutectic structure can be made not more than 5 μm and maximum grain size of primary silicon crystal can be made not more than 50 μm.

A continuous casting process is most suitable as the casting process for practice of the present invention. That is, according to the continuous casting process, an ingot is produced with the liquid phase being always transferred in one direction at solidification and therefore less inclusion of gas and impurities and formation of cavities are caused and thus an homogeneous ingot having less difference in components the in surface portion and inner portion of the ingot can be produced. Furthermore, this process is suitable for mass production.

Plastic working of an ingot according to the present invention is carried out for obtaining the desired metal structure and may be carried out in a cold or hot manner or in combination of the working and heat treatment. In this case, there must not be applied such temperature history as causing growth of silicon crystal in eutectic structure, especially expansion of width before subjecting to plastic working of at least 30%. By the plastic working, silicon crystal in eutectic structure and α-aluminum crystal are divided and refined and thus refined silicon crystal in eutectic structure is homogeneously dispersed in the aluminum matrix.

Sketches of typical forms of silicon crystal in eutectic structure are shown in FIGS. 1*a* - 1*d*. FIG. 1*a* shows eutectic silicon crystal in eutectic structure crystallized with sufficiently narrow width. FIG. 1*b* shows the silicon of FIG. 1*a* which is divided by plastic working.

When homogenizing heat treatment is conducted without plastic working, the silicon crystal is aggregated into masses as shown in FIG. 1c. This mass is not conspicuously divided and refined by plastic working. Therefore, tenacity of aluminum alloy having such silicon crystal cannot be sufficiently improved. On the other hand, in silicon crystal in eutectic structure divided by plastic working, precipitation strengthening components are precipitated by suitable heat treatment and granulation is also caused to result in such structure as shown in FIG. 1d. If silicon crystal in eutectic structure is divided as shown in FIG. 1b, most of the silicon crystal divided is not rebonded or aggregated into mass by heat treatment such as annealing.

The plastic working may be conducted by various means such as forging, rolling, extrusion, drawing, upsetting, etc.

The effect of the working can be clearly recognized by measuring the elongation percentage of the alloy. The elongation percentage begins to increase at the working ratio of near 15% and reaches saturation at about 30%. Therefore, the working ratio of the plastic working is required to be at least 30%.

When the alloy is subjected to suitable heat treatment at a temperature of at least 200° C after the plastic working, the silicon crystal divided becomes roundish and precipitation strengthening of the matrix occurs. Since ductility of the alloy improved by the plastic working is hardly lost by said heat treatment, high tenacity is imparted to this alloy.

Precipitation strengthening of the alloy according to the present invention may be accomplished by $T_4$, $T_5$ and $T_6$ treatments. The $T_4$, $T_5$ and $T_6$ treatments as aging treatment of aluminum are well known in this field. The $T_4$ treatment comprises solid solution heat treatment and natural aging, the $T_5$ treatment is hot aging heat treatment and the $T_6$ treatment comprises solid solution heat treatment and subsequent aging heat treatment.

Besides these aging treatments, an annealing treatment comprising keeping the alloy at 350° - 430° C for at least one hour and then slowly cooling it can further improve the ductility of the alloy which is a special property of the alloy according to the present invention. The alloy having the compositions of the present invention, wherein contents of copper and magnesium are low exhibits an elongation percentage of at least 25% and such alloy having high elongation percentage can be utilized as wrought material which is to be worked at a temperature lower than recrystallizing temperature.

The alloy can be strengthened by subjecting it to said $T_4$, $T_5$ and $T_6$ treatments after cold working, but sufficient strength can be obtained by the work hardening due to the cold working. Therefore, the aging heat treatments may be omitted.

The term "working ratio" herein used means reduction of section in the case of extrusion, drawing and the like and reduction of thickness or height in the case of rolling or forging.

Products desired can be produced by the processes as explained above, but the products may be finished by subjecting them to further treatment such as cutting, extrusion, press, welding, surface treatments, etc.

EXAMPLE 1

An alloy having the composition of 10.91 Si — 2.4 Cu — 0.48 Mg — 0.02 Fe — the balance Al was molten. Ingots having a diameter of 30 - 200 mm Φ were produced therefrom at solid cooling rates of 90° C/sec, 25° C/sec, 15° C/sec and 5° C/sec by unidirectional solidifying method. Then, the resultant ingots were preheated to 400° C, subjected to backward extrusion at a working ratio of 60% and test pieces for tension test were taken therefrom. FIGS. 5a - 5d are microstructures of the ingots. Forms of silicon crystal in eutectic structure and primary silicon crystal in the structure greatly varied depending upon solid cooling rate and they became finer with increase in solid cooling rate. There was a clear difference in the form at a cooling rate of 15° C/sec and that of 5° C/sec. At a solid cooling rate of less than 5° C/sec, width of silicon crystal in eutectic structure became larger and the mean width became more than 5 μm and moreover the massive primary silicon crystal also became greater. It was concluded that the solid cooling rate must be kept at 10° C/sec or higher, especially more than 15° C/sec enough.

FIGS. 6a and 6b are microstructures of alloys which were produced at solid cooling rates of 15° C/sec and 5° C/sec, respectively and subjected to $T_6$ treatment after hot working. The finely crystallized silicon crystal in eutectic structure was more finely divided and homogeneously dispersed and granulated by the subsequent $T_6$ treatment. However, when mean width of silicon crystal in eutectic structure was more than 5 μm, namely, there was much coarse eutectic silicon crystal, such coarse eutectic silicon crystal was not very divided and even if divided, it became flattly granular and the dispersion state also did not become homogeneous. On the other hand, although not shown in the drawing, it has been confirmed that primary silicon crystal is not divided by said working.

FIG. 7 shows the results of tension test at room temperature. The higher the solid cooling rate was, the greater were the increases in tensile strength and elongation by the working. It seems this is because the hard silicon crystal of eutectic structure was divided and granulated, thereby to avoid stress concentration. Heat treatment for a long period of 50 hours at 500° C instead of said plastic working could also cause granulation of silicon crystal in eutectic structure, but in this case substantially no increase in tensile strength was brought about and increase in elongation percentage was about ½ of the increase caused by the plastic working. It has been usually considered that refining of silicon crystal in eutectic structure by working generally makes the matrix brittle. On the contrary, however, according to the present invention, cold or hot plastic working much contributes to increase in tenacity of eutectic alloy. Working ratio has great influence on refining of silicon crystal in eutectic structure by division.

Ingots produced by employing a solid cooling rate of 15° C/sec were preheated to 400° C, subjected to hot plastic working at reduction of section of 10, 20, 30, 60 and 85% and then subjected to a tension test. The results are shown in FIG. 8. Until working ratio of about 40%, the elongation percentage abruptly increased with increase in working ratio and thereafter the elongation percentage increased slowly. From the results, it has become clear that a working ratio of at least 30% is preferred.

EXAMPLE 2

An aluminum alloy comprising the desired compositions was molten, from which ingots having a diameter of 150 mm Φ were produced under the condition that the solid cooling rate was at least 15° C/sec. by continuous casting process. Chemical compositions (analytical values) of the ingots are shown in Table 1.

Table 1

| | Si | Cu | Mg | Fe | Al | Mean width of silicon crystal in eutectic structure | Maximum grain size of primary silicon crystal |
|---|---|---|---|---|---|---|---|
| No. 1 | 11.0 | 2.4 | 0.47 | 0.22 | Balance | 1.7 μm | — |
| No. 2 | 5.9 | 2.4 | 0.28 | 0.11 | " | 1.5 μm | — |
| No. 3 | 8.2 | 2.4 | 0.40 | 0.12 | " | 1.5 μm | — |
| No. 4 | 13.6 | 2.8 | 0.29 | 0.23 | " | 1.7 μm | 50 μm |
| No. 5 | 16.1 | 2.7 | 0.31 | 0.23 | " | 1.7 μm | 70–90 μm |

Then, the ingots were preheated to 450° C and worked by backward extrusion process at a working ratio of 80% into cup-shaped cylindrical articles. Various test pieces were taken from cylindrical part and subjected to various tests. The test pieces were subjected to $T_4$, $T_5$ and $T_6$ treatments. The test pieces were kept at various temperatures of from room temperature to 300° C for one hour and then subjected to a tension test. The results are shown in FIG. 9. The alloy No. 1 which was close to eutectic composition and which had the greatest amount of eutectic structure had many dispersed granules and had high strength. The alloy No. 2 less in silicon content had the tendency of reduction in strength at higher temperature.

FIG. 10 shows the relation between silicon content and elongation at room temperature (of ingot as cast and that subjected to hot working of 80% and then $T_6$ treatment). Regarding the elongation of ingot as cast (that is, silicon crystal of eutectic structure was not divided), the ingot No. 2 having a low silicon content of 6% showed a high value of at least 10%, but the elongation decreased with increase in silicon content and decreased to less than 5% at a silicon content of 8% or more. Next, elongation of alloy where silicon crystal of eutectic structure was divided by a hot working of 80% was improved with increase in silicon content and even the alloy having a silicon content of 14% showed 10% or more. Size effect of silicon crystal of eutectic structure due to plastic working became conspicuous when silicon content was 8% or more. FIG. 11 shows the results of Ohkoshi abrasion test. This test was conducted under the conditions of final load: 18.9 kg. friction distance: 600 m, friction speed: 2 m/sec, rubbing material (rotating body): JIS FC 30. The abrasion resistance was improved with increase in silicon content. When silicon content was less than 8%, the abrasion resistance was low. For comparison, an abrasion test was conducted on JIS AC8A alloy generally used as piston material under the same conditions as mentioned above to obtain specific wearing-out amount of not less than $8 \times 10^{-9}$ mm²/kg. Thus, the alloy of the present invention had abrasion resistance equal to or more than that of JIS AC8A alloy.

In many cases, aluminum materials are used in combination with steel materials. In such case, the conventional aluminum alloys have the problem that they have higher linear thermal expansion coefficient as compared with steels and so those of low thermal expansion coefficient are preferred as structure aliminum materials. FIG. 12 shows the relation between silicon content and linear thermal expansion coefficient (room temperature – 100° C). The linear thermal expansion coefficient decreased with increase in silicon content. As low linear thermal expansion aluminum alloys, those of 8% silicon content which have a linear thermal expansion coefficient of not more than $21 \times 10^{-6}$ ° C are preferred.

One of the effects of the ingot according to the present invention is superiority in heat treatability. FIG. 13 shows the results of tension test on the ingot No. 1 which was conducted by preheating the ingot at 400° C, hot working (back extrusion process) at a working ratio of 80% and then subjecting it to $T_4$, $T_5$ and $T_6$ treatments. (The test was not conducted on the alloy No. 3, No. 4 and No. 5 of high silicon content because these alloys were similar to the ingot No. 1.) In the aluminum-silicon alloy of the present invention, since the crystallized silicon phase is fine, heat treatability was improved and a strength of at least 40 kg/mm² could be obtained by $T_4$, $T_5$ and $T_6$ treatments. Therefore, the alloy is advantageous in operability and heat economy.

In the alloy system of the present invention, size and distribution of primary silicon crystal influence strength and elongation. The alloy No. 4 was cast at solid cooling rates of 5° – 200° C/sec to produce ingots different in size of primary silicon crystal grain. These ingots were subjected to backward extrusion process at reduction of section of 80% at 400° C. Pieces for tension test were taken from thus extruded products and they were subjected to $T_6$ treatment and then to tension test at room temperature.

With increase in solid cooling rate, both the average grain size and maximum grain size of primary silicon crystal became smaller and elongation of the alloy was increased. However, the elongation had also a relation with area ratio of primary silicon and cannot be specified merely by average grain size. It was confirmed that in the case of alloy No. 4 grain size of primary silicon crystal can be made nearly less than 50 μm by employing a solid cooling rate of 5° C/sec or more and in the case of an area ratio of not more than 6%, there are no practical problems at a maximum grain size of less than 50 μm. Ductility of alloy depends greatly upon grain size of silicon crystal in eutectic structure and hence it has been found that solid cooling rate in the present invention may be determined mainly from eutectic structure.

Next, an inoculant mainly consisting of strontium and phosphorus was added to a melt of the alloy components of alloy No. 4 and ingot was prepared therefrom. A small piece was taken from the ingot and section was polished. Size of primary silicon crystal was observed by a microscope. As compared with the ingot to which no inoculant was added, amount of primary silicon crystal was reduced, average grain size and maximum grain size were decreased, simultaneously grain size of eutectic structure were also very refined. Even when the solid cooling rate 5° C/sec, average primary silicon crystal grain size was less than 5 μm and maximum grain size was about 25 μm.

EXAMPLE 3

Alloys having the compositions as shown in the following Table 2 were molten and cast by continuous casting process at a casting temperature of 750° C and a solid cooling rate of higher than 15° C/sec to produce ingots of 150 mm Φ (in diameter).

Table 2

| No. | Si | Mg | Cu | Fe | Al | Average width of silicon crystal in eutectic structure (μm) | Maximum grain size of primary silicon crystal (μm) |
|---|---|---|---|---|---|---|---|
| No. 6 | 11.3 | 0.01 | 2.9 | 0.20 | Balance | 1.7 | Not more than 20 |
| No. 7 | 11.3 | 0.08 | 2.9 | 0.21 | " | 1.7 | " |
| No. 8 | 11.5 | 0.51 | 2.8 | 0.21 | " | 1.7 | " |
| No. 9 | 11.3 | 0.72 | 3.1 | 0.21 | " | 1.7 | " |
| No. 10 | 11.1 | 0.98 | 3.1 | 0.20 | " | 1.7 | " |

After the continuous casting, castability of the ingots was examined from their surface condition to find that the ingot No. 9 and No. 10 which were high in magnesium content had wrinkles of more than 2 mm in depth and were lowered in continuous castability. The ingots were subjected to plastic working of 30% at 400° C, then annealed at 350° C, cold-extruded at a working ratio of 60% and thereafter subjected to $T_6$ treatment. The thus worked ingots were subjected to machinability test and Charpy impact test. The machinability was evaluated from life of cutting tool, cutting resistance, roughness of cut surface and shapes of chips. Table 3 shows machinability at a cutting depth of 1 mm, a feeding amount of 0.15 mm/rotation and a cutting speed of 120 m/min.

Table 3

| | Cutting resistance (tangential force) | Roughness of the finished surface Hmax . μm | Shape of chips |
|---|---|---|---|
| No. 6 | 16.5 | 12 | Continuous type |
| No. 7 | 12.6 | 9 | discontinuous type |
| No. 8 | 8.8 | 7 | " |
| No. 9 | 8.4 | 6 | " |
| No. 10 | 8.2 | 6 | " |

Magnesium content greatly influenced the machinability and a magnesium content of at least 0.05% was required for obtaining practical machinability. FIG. 14 shows Charpy impact value. The impact value lessened with increase in magnesium content and was constant when magnesium content exceeded 0.72%.

The ingot No. 7 and No. 8 and the comparative JIS 2017 alloy were subjected to stress corrosion tests by giving thereto predetermined stresses of 15 kg/mm² and 20 kg/mm² in a solution consisting of 36 g of $CrO_3$, 30 g of $K_2Cr_2O_7$, 3 g of sodium chloride and 1 l of pure water. No cracks were caused in the present ingots No. 7 and No. 8 while cracks occurred in JIS 2017 alloy (Duralumin) under stress of 20 kg/mm². From this fact, it is clear that the alloy of the present invention can also be used as a high tensile aluminum alloy capable of exhibiting a tensile strength of more than 40 kg/mm² and excellent in stress corrosion cracking resistance.

EXAMPLE 4

Alloys having the composition as shown in Table 4 were molten and casted by continuous casting process at a solid cooling rate of 75° C/sec to obtain ingots of 100 mmΦ.

Table 4

| No. | Si | Mg | Cu | Al | Average width of silicon crystal of eutectic structure (μm) | Maximum grain size of primary silicon crystal (μm) |
|---|---|---|---|---|---|---|
| No. 11 | 8.5 | 0.36 | 1.3 | Balance | 1.7 | — |
| No. 12 | 9.3 | 0.22 | 2.4 | " | " | — |
| No. 13 | 9.7 | 0.09 | 3.4 | " | " | — |
| No. 14 | 9.9 | 0.28 | 3.0 | " | " | — |

After the continuous casting, the ingots were subjected to plastic working of about 50% by forging, then kept at a temperature range of 350° - 420° C for 2 hours, and thereafter slowly cooled to complete annealing. Test piece for tension test was taken from a part of each annealed alloys. Each of the remaining alloys were subjected to cold extrusion working at a working ratio of 30 - 50%. Tensile strength after the cold working, surface roughness measured by optical method of the worked surface and tensile strength when the alloys were subjected to $T_6$ treatment after the cold working are shown in Table 5.

Table 5

| No. | Elongation percentage after annealing (%) | Tensile strength (kg/mm²) 30% cold working | 50% cold working | $T_6$ treatment after cold working | Surface roughness after cold working Hmax (μm) |
|---|---|---|---|---|---|
| No. 11 | 33 | 36 | 41 | 41 | less than 20 |
| No. 12 | 28 | 38 | 42 | 44 | less than 20 |
| No. 13 | 26 | 38 | 40 | 42 | less than 25 |
| No. 14 | 26 | 37 | 42 | 47 | less than 20 |
| JIS 2017 (for comparison) | — | — | — | 46 | 110 |

In the last column of the above Table 5, strength of JIS 2017 alloy and maximum surface roughness when extruded are shown.

As compared with the comparative JIS 2017 alloy, the alloys of the present invention were much superior in cold workability.

The ingot of alloy No. 12 was subjected to plastic working of 50%, then kept at a temperature of 350° - 470° C for 1 hour and thereafter slowly cooled. Thus, effect of annealing temperature was examined. The results are shown in FIG. 15. The hardness decreased at an annealing temperature of 350° - 420° C and it was confirmed that said range of the temperature is optimum for annealing.

Next, relation between silicon content and size of grain of silicon crystal and annealing effect was shown in FIG. 16. Melts of various aluminum alloys containing not more than 16% by weight of silicon aiming at magnesium content of 0.3% by weight and copper content of 0.7% by weight were prepared. One of them was cast at a solid cooling rate of 40° - 60° C/sec which was within the scope of casting condition of the present invention and the other was cast at a solid cooling rate of 2° - 5° C/sec. They were subjected to plastic working of about 70% by rolling, then kept in an annealing furnace at 390° ± 5° C for one hour and then slowly cooled to complete the annealing. Pieces for tension test were taken from thus annealed materials and elongation percentages thereof at room temperature was measured. The annealing effect was clearly expressed by elongation percentage. That is, in the case of the alloy containing large silicon crystal shown by curve 2 in FIG. 16, the elongation percentage somewhat increased at around the eutectic components, but decreased nearly in inverse proportion to the silicon content. On the other hand, when silicon crystal in eutetic structure and primary silicon crystal were sufficiently fine, a peculiar annealing effect was exhibited at a silicon content of 5 - 15% by weight and conspicuous improvements in elongation and ductility were caused. An elongation of at least 25% is preferred for using as a cold working material and the alloy containing 8 - 11% by weight of silicon surely has such high ductility. Such high ductility is sufficient as wrought materials and moreover since the alloy had a high silicon content, wrought surface was also markedly beautiful.

EXAMPLE 5

A melt of an alloy consisting of 0.3% Mg - 3.4% Cu - 11.7% Si — the balance Al was cast at a solid cooling rate of 45° C/sec into a slab of 160 mmΦ by the continuous casting process. The resultant ingot was worked into a plate of 22 mm in thickness by hot rolling at 350° C. This plate was subjected to machining to obtain a test piece in the form of strip of 200 mm in length, 100 mm in width and 20 mm in thickness. These pieces were butted in their longitudinal direction and the butted portions were welded by EBW welding (electron beam welding) and TIG welding (tungsten electrode-inert gas welding) and thereafter they were subjected to $T_6$ treatment. Test pieces were taken therefrom in such a manner that they cross the welding line and they were subjected to tension test at room temperature.

The electron beam welding was conducted under the welding conditions: I-shaped beveling; input heat . . . 3.6 k Joul/cm; welding speed . . . 0.5 m/min. The TIG welding was carried out with V-shaped beveling of 60° and with use of a welding rod of 3.2 mmΦ having the same compositions as the test pieces to be welded and at 200 - 250 A and 18 V alternating current. Strength and ductility of the welded portion were shown in Table 6.

Table 6

| | $\sigma 0.2$ (kg/mm²) | $\sigma B$ (kg/mm²) | $\delta$(%) | $\phi$(%) |
|---|---|---|---|---|
| EBW | 35 | 43 | 6 | 10 |
| TIG | 36 | 44 | 7 | 20 |

Surface of the weld portion was smooth, there were no defects such as blow holes and cracks and substantialy no deterioration in heat effecting zone of the test pieces was recognized.

In the conventional aluminum alloys, when copper content is high, welding cracks are apt to occur while the alloy of the present invention had substantially no such troubles and showed excellent weldability. Furthermore, since the present alloy is excellent in workability, it is also easy to form the welding rod.

As explained in detail above, the alloy of the present invention can be obtained by combination of the selected compositions, suitable casting condtions, subsequent plastic working and suitable heat treatments and it has simultaneously high mechanical properties, high abrasion resistance, high corrosion resistance and excellent workability. Furthermore, the present alloy is also superior in wettability with various organic adhesives and coating materials and can be subjected to anodizing treatment with a chromic acid bath. Thus, it has extremely wide uses.

What is claimed is:

1. A cast product which provides an aluminum-silicon alloy having markedly improved mechanical properties and machinability by plastic working and heat treatment, said cast product consisting essentially of 8-15% by weight of silicon, 1-4.5% by weight of copper, 0.05-0.7% by weight of magnesium and the balance being substantially aluminum, said cast product further characterized by tabular or flaky silicon crystal in eutectic structure having a mean width of not greater than 5μm and being finely and homogeneously dispersed in an aluminum matrix, and the area ratio of primary silicon crystal in the aluminum matrix being not greater than 6% and the maximum grain size of said primary silicon crystal being not greater than 50 μm.

2. A cast product according to claim 1, wherein relation between magnesium content and copper content satisfies the area surrounded by the line connecting point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A in FIG. 4.

3. An aluminum-silicon alloy having extremely improved mechanical properties, workability, and stress corrosion resistance, said alloy consisting essentially of 8-15% by weight of silicon, 1-4.5% by weight of copper, 0.05-0.7% by weight of magnesium and the balance being substantially aluminum, said alloy further characterized by silicon crystal in eutectic structure having an average grain size not greater than 5 μm and being finely and homogeneously dispersed in an aluminum matrix, the area ratio of primary silicon crystal in the aluminum matrix being not greater than 6%, the maximum grain size of said primary silicon crystal being not greater than 50 μm, and intermetallic compounds of copper and magnesium being finely and homogeneously dispersed in the aluminum matrix.

4. An aluminum-silicon alloy according to claim 3, wherein the relation between copper and magnesium contents satisfies the area surrounded by the line which connects point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A in FIG. 4.

5. An aluminum-silicon alloy having cold workability consisting essentially of 8-11% by weight of silicon, copper and magnesium in the amounts within the area surrounded by the line which connects point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A, the balance being substantially aluminum, said alloy further characterized by silicon crystal in eutectic structure having an average grain size not greater than 5 μm and being finely and homogeneously dispersed in an aluminum matrix, the area ratio of primary silicon crystal in the aluminum matrix being not greater than 6%, the maximum grain size of said primary silicon crystal being not greater than 50 μm, and the alloy being in an annealed state.

6. A method for producing a cast product which provides an aluminum-silicon alloy having markedly improved mechanical properties, workability, and stress corrosion resistance by plastic working and heat treatment, which comprises solidifying and cooling in a water cooling mold a melt of an alloy consisting essentially of 8–15% by weight of silicon, 1–4.5% by weight of copper, 0.05–0.7% by weight of magnesium and the balance being substantially aluminum, the solid cooling rate after solidification of the melt being kept at 10° C/sec. or higher to crystallize tabular or flaky silicon crystal having a mean width of not more than 5 μm in eutectic structure in an aluminum matrix and to crystallize primary silicon crystal having a maximum grain size not greater than 50 μm in the aluminum matrix, the area ratio of said primary silicon crystal crystallized in the aluminum matrix being not greater than 6%.

7. A method for producing a cast product according to claim 6, wherein the relation between copper and magnesium contents satisfies the area surrounded by the line which connects point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A in the accompanying FIG. 4.

8. A method for producing a cast product which provides an aluminum-silicon alloy having extremely improved mechanical properties and workability by plastic working and age-hardening treatment, which comprises pouring a melt of an alloy consisting essentially of 8–15% by weight of silicon, 1–4.5% by weight of copper, 0.05–0.7% by weight of magnesium and the balance being substantially aluminum into a water cooling mold, solidifying at least a surface portion thereof in the mold to produce an ingot, continuously taking out the ingot from the bottom of the mold and simultaneously cooling the taken-out ingot by jetting water to the surface of the ingot, the solid cooling rate of the ingot being kept at 10° C/sec. or higher to crystallize tabular or flaky silicon crystal having a means crystal width of not more than 5 μm in eutectic structure in an aluminum matrix and to crystallize primary silicon crystal having a maximum grain size not greater than 50 μm in the aluminum matrix, the area ratio of said primary silicon crystal crystallized in the aluminum matrix being not greater than 6%.

9. A method for producing a cast product according to claim 8, wherein the relation between copper content and magnesium content satisfies the area surrounded by the line which connects point A (Cu 4.5%, Mg 0.05%), point B (Cu 3%, Mg 0.05%), point C (Cu 1%, Mg 0.3%), poknt D (Cu 1%, Mg 0.06%), point E (Cu 4%, Mg 0.7%) and the point A in FIG. 4.

10. A method for producing an aluminum-silicon alloy having improved mechanical properties and workability which comprises pouring a melt of an alloy consisting essentially of 8–15% by weight of silicon, 1–4.5% by weight of copper, 0.05–0.7% by weight of magnesium and the balance being substantially aluminum into a water cooling mold, solidifying at least a surface portion thereof in the mold to produce an ingot, continuously taking out the ingot from the bottom of the mold, simultaneously cooling the taken-out ingot by jetting water to the surface of the ingot, the solid cooling rate of the ingot being kept at 10° C/sec. or higher to crystallize tabular or flaky silicon crystal having a mean width of not more than 5 μm in eutectic structure in an aluminum matrix and to crystallize primary silicon crystal having a maximum grain size not greater than 50 μm in the aluminum matrix, the area ratio of said primary silicon crystal crystallized in the aluminum matrix being not greater than 6%, then subjecting a thus obtained cast product to a plastic working of at least 30% in a working ratio without causing increase in width of said silicon crystal in eutectic structure and heat treating said plastic worked product.

11. A method for producing an aluminum-silicon alloy according to claim 10, wherein the relation between copper and magnesium contents satisfies the area surrounded by the line which connects point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A in FIG. 4.

12. A cast product according to claim 1, wherein the relation between copper and magnesium contents satisfies the area surrounded by the line which connects point *a* (Cu 3%, Mg 0.15%), point *b* (Cu 2%, Mg 0.3%), point *c* (Cu 2%, Mg 0.5%), point *d* (Cu 2.5%, Mg 0.6%), point *e* (Cu 3%, Mg 0.65%), point *f* (Cu 3.5%, Mg 0.6%), point *g* (Cu 3.9%, Mg 0.3%) and the point A in the accompanying FIG. 4.

13. An aluminum-silicon alloy according to claim 3, wherein the relation between copper and magnesium contents satisfies the area surrounded by the line which connects point *a* (Cu 3%, Mg 0.15%), point *b* (Cu 2%, Mg 0.3%), point *c* (Cu 2%, Mg 0.5%), point *d* (Cu 2.5%, Mg 0.6%), point *e* (Cu 3%, Mg 0.65%), point *f* (Cu 3.5%, Mg 0.6%), point *g* (Cu 3.9%, Mg 0.3%) and the point a in the accompanying FIG. 4.

14. A method for producing a cast product according to claim 6, wherein the relation between copper and magnesium contents satisfies the area surrounded by the line which connects point *a* (Cu 3%, Mg 0.15%), point *b* (Cu 2%, Mg 0.3%), point *c* (Cu 2%, Mg 0.5%), point *d* (Cu 2.5%, Mg 0.6%), point *e* (Cu 3%, Mg 0.65%), point *f* (Cu 3.5%, Mg 0.6%), point *g* (Cu 3.9%, Mg 0.3%) and the point *a* in the accompanying FIG. 4.

15. A method for producing a cast product according to claim 8, wherein the relation between copper and magnesium contents satisfies the area surrounded by the line which connects point *a* (Cu 3%, Mg 0.15%), point *b* (Cu 2%, Mg 0.3%), point *c* (Cu 2%, Mg 0.5%), point *d* (Cu 2.5%, Mg 0.6%), point *e* (Cu 3%, Mg 0.65%), point *f* (Cu 3.5%, Mg 0.6%), point *g* (Cu 3.9%, Mg 0.3%) and the point *a* in the accompanying FIG. 4.

16. A method for producing an alloy according to claim 10, wherein the relation between copper and magnesium contents satisfies the area surrounded by the line which connects point *a* (Cu 3%, Mg 0.15%), point *b* (Cu 2%, Mg 0.3%), point *c* (Cu 2%, Mg 0.5%), point *d* (Cu 2.5%, Mg 0.6%), point *e* (Cu 3%, Mg 0.65%), point *f* (Cu 3.5%, Mg 0.6%), point *g* (Cu 3.9%, Mg 0.3%) and the point *a* in the accompanying FIG. 4.

17. A method for producing an aluminum-silicon alloy of claim 5, which comprises solidifying and cooling in a mold a melt of an alloy comprising 8 – 11% by weight of silicon, copper and magnesium in the amounts which satisfy the area surrounded by the line which connects point A (Cu 4.5%, Mg 0.05%), point B (Cu 3%, Mg 0.05%), point C (Cu 1%, Mg 0.3%), point D (Cu 1%, Mg 0.6%), point E (Cu 4%, Mg 0.7%) and the point A in the accompanying FIG. 4, and the balance being substantially aluminum, solid cooling rate of the melt after solidification being kept at 15° C/sec or higher to crystallize tabular or flaky silicon crystal having a mean width of not more than 5 μm in eutectic structure in aluminum matrix, subjecting the ingot to a plastic working of at least 30% in a working ratio and annealing and heat treating the ingot.

18. A cast product which provides an aluminum-silicon alloy having markedly improved mechanical properties and machinability by plastic working and heat treatment, said cast product consisting essentially of 8–15% by weight of silicon, 1–4.5% by weight of copper, 0.05–0.7% by weight of magnesium, up to 0.7% by weight of iron, up to 0.15% by weight each or in sum total of chromium, manganese, nickel, zirconium, or titanium, and the balance being substantially aluminum, said cast product further characterized by tabular or flaky silicon crystal in eutectic structure having a mean width of not greater than 5 μm and being finely and homogeneously dispersed in an aluminum matrix, and the area ratio of primary silicon crystal in the aluminum matrix being not greater than 6% and the maximum grain size of said primary silicon crystal being not greater than 50 μm.

19. An aluminum-silicon alloy having extremely improved mechanical properties, workability, and stress corrosion resistance, said alloy consisting essentially of 8–15% by weight of silicon, 1–4.5% by weight of copper, 0.05 – 0.7% by weight of magnesium, up to 0.7% by weight of iron, up to 0.15% by weight each or in sum total of chromium, manganese, nickel, zirconium, or titanium, and the balance being substantially aluminum, said alloy further characterized by silicon crystal in eutectic structure having an average grain size not greater than 5 μm and being finely and homogeneously dispersed in an aluminium matrix, the area ratio of primary silicon crystal in the aluminum matrix being not greater than 6%, the maximum grain size of said primary silicon crystal being not greater than 50 μm, and intermetallic compounds of copper and magnesium being finely and homogeneously dispersed in the aluminum matrix.

20. A method for producing a cast product which provides an aluminum-silicon alloy having extremely improved mechanical properties and workability by plastic working and age-hardening treatment, which comprises pouring a melt of an alloy consisting essentially of 8–15% by weight of silicon, 1–4.5% by weight of copper, 0.05–0. 7% by weight of magnesium, up to 0.7% by weight of iron, up to 0.15% by weight each or in sum total of chromium, manganese, nickel, zirconium, or titanium, and the balance being substantially aluminum into a water cooling mold, solidifying at least a surface portion thereof in the mold to produce an ingot, continuously taking out the ingot from the bottom of the mold and simultaneously cooling the taken-out ingot by jetting water to the surface of the ingot, the solid cooling rate of the ingot being kept at 10° C/sec. or higher to crystallize tabular or flaky silicon crystal having a mean crystal width of not more than 5 μm in eutectic structure in an aluminum matrix and to crystallize primary silicon crystal having a maximum grain size not greater than 50 μm in the aluminum matrix, the area ratio of said primary silicon crystal crystallized in the aluminum matrix being not greater than 6%.

21. A method for producing an aluminum-silicon alloy having improved mechanical properties and workability which comprises pouring a melt of an alloy consisting essentially of 8–15% by weight of silicon, 1–4.5% by weight of copper, 0.05–0.7% by weight of magnesium, up to 0.7% by weight of iron, up to 0.15% by weight each or in sum total of chromium, manganese, nickel, zirconium, or titanium, and the balance being substantially aluminum into a water cooling mold, solidfying at least a surface portion thereof in the mold to produce an ingot, continuously taking out the ingot from the bottom of the mold, simultaneously cooling the taken-out ingot by jetting water to the surface of the ingot, the solid cooling rate of the ingot being kept at 10° C/sec. or higher to crystallize tabular or flaky silicon crystal having a mean width of not more than 5 μm in eutectic structure in an aluminum matrix, and to crystallize primary silicon crystal having a maximum grain size not greater than 50 μm in the aluminum matrix, the area ratio of said primary silicon crystal crystallized in the aluminum matrix being not greater than 6%, then subjecting a thus obtained cast product to a plastic working of at least 30% in a working ratio without causing increase in width of said silicon crystal in eutectic structure and heat treating said plastic worked product.

22. An aluminum-silicon alloy according to claim 4 which has a tensile strength of at least 40 kg/mm$^2$ and an elongation of at least 10%.

23. An aluminum-silicon alloy according to claim 13 which has a tensile strength of at least 45 kg/mm$^2$ and an elongation of at least 10%.

* * * * *